US012577796B2

(12) United States Patent
Zhang

(10) Patent No.: US 12,577,796 B2
(45) Date of Patent: Mar. 17, 2026

(54) SINGLE-OPENING WALL CRACK INTELLIGENT GROUTING MACHINE AND CONSTRUCTION METHOD

(71) Applicants: JIANGMEN RONGQUAN CONSTRUCTION TECHNOLOGY CO., LTD., Jiangmen City (CN); Yihong Zhang, Jiangmen (CN)

(72) Inventor: Yihong Zhang, Jiangmen (CN)

(73) Assignees: Yihong Zhang, Jiangmen (CN); JIANGMEN RONGQUAN CONSTRUCTION TECHNOLOGY CO., LTD., Jiangmen City (CN)

( * ) Notice: Subject to any disclaimer, the term of this patent is extended or adjusted under 35 U.S.C. 154(b) by 258 days.

(21) Appl. No.: 18/578,870

(22) PCT Filed: Jun. 24, 2022

(86) PCT No.: PCT/CN2022/101149
§ 371 (c)(1),
(2) Date: Jan. 12, 2024

(87) PCT Pub. No.: WO2023/284527
PCT Pub. Date: Jan. 19, 2023

(65) Prior Publication Data

US 2024/0301709 A1 Sep. 12, 2024

(30) Foreign Application Priority Data

Jul. 14, 2021 (CN) ..... 202110796782.4

(51) Int. Cl.
*E04G 23/02* (2006.01)

(52) U.S. Cl.
CPC ..... *E04G 23/0211* (2013.01)

(58) Field of Classification Search
CPC ..... B05C 21/00; B05C 5/02; E04G 23/0211
See application file for complete search history.

(56) References Cited

U.S. PATENT DOCUMENTS 3,102,829 A * 9/1963 Rathbun, Jr. ..... E04G 23/0203 118/410
3,865,075 A * 2/1975 Klein ..... C04B 41/61 404/75
4,884,922 A * 12/1989 Haq ..... E04G 23/0211 52/742.16
5,809,736 A * 9/1998 Naito ..... E04G 23/0211 52/742.16

(Continued)

FOREIGN PATENT DOCUMENTS

CN 2397209 Y 9/2000
CN 2916014 Y 6/2007

(Continued)

OTHER PUBLICATIONS

CN 202110796782.4—First Office Action, dated Feb. 26, 2023, 6 pages.

(Continued)

*Primary Examiner* — Gisele D Ford
(74) *Attorney, Agent, or Firm* — Quarles & Brady LLP

(57) ABSTRACT

A single-opening wall crack intelligent grouting machine and a construction method are disclosed. The single-opening wall crack intelligent grouting machine includes a bottom plate, two lifting mechanisms are symmetrically fixed on an upper surface of the bottom plate, a connecting beam is fixed between the two lifting mechanisms, a middle portion of the connecting beam is slidably connected with a horizontal moving device, a grouting mechanism is fixed on a top portion of the horizontal moving device, a troweling mechanism is fixed on a top portion of the grouting mechanism, and self-locking universal wheels are symmetrically fixed on a lower surface of the bottom plate.

10 Claims, 7 Drawing Sheets

(56) References Cited

U.S. PATENT DOCUMENTS

| | | | | |
|---|---|---|---|---|
| 10,059,033 | B2 * | 8/2018 | Wittbold | B05C 5/0254 |
| 11,198,978 | B1 * | 12/2021 | Rakshit | E04G 23/0211 |
| 2009/0313939 | A1 * | 12/2009 | Fujita | E04G 23/0203 52/742.13 |
| 2010/0092248 | A1 * | 4/2010 | Kim | E04G 23/0203 405/269 |
| 2018/0229252 | A1 * | 8/2018 | Kochan, Jr. | B65D 81/325 |
| 2018/0251990 | A1 | 9/2018 | Sasaki et al. | |
| 2019/0078343 | A1 * | 3/2019 | Hwang | E04G 23/0211 |
| 2022/0412109 | A1 * | 12/2022 | Lee | B05B 7/0408 |

FOREIGN PATENT DOCUMENTS

| | | | |
|---|---|---|---|
| CN | 205777399 | U | 12/2016 |
| CN | 207453514 | U | 6/2018 |
| CN | 110541577 | A | 12/2019 |
| CN | 111042479 | A | 4/2020 |
| CN | 211523974 | U | 9/2020 |
| CN | 111749490 | A | 10/2020 |
| CN | 112681797 | A | 4/2021 |
| CN | 113107166 | A | 7/2021 |
| CN | 113404325 | A | 9/2021 |
| JP | S61109866 | A | 5/1986 |

OTHER PUBLICATIONS

PCT/CN2022/101149—International Search Report and Written Opinion, dated Sep. 22, 2022, 9 pages.

* cited by examiner

SINGLE-OPENING WALL CRACK INTELLIGENT GROUTING MACHINE AND CONSTRUCTION METHOD

CROSS-REFERENCE TO RELATED APPLICATIONS

This application is a national stage filing under 35 U.S.C. § 371 of international application number PCT/CN2022/101149, filed Jun. 24, 2022, which claims priority to Chinese patent application No. 2021107967824 filed Jul. 14, 2021. The contents of these applications are incorporated herein by reference in their entirety.

TECHNICAL FIELD

The present disclosure relates to the technical field of grouting machines, and particularly to a single-opening wall crack intelligent grouting machine and a construction method.

BACKGROUND

Architectural engineering, as a part of constructional engineering, refers to an engineering entity formed by the construction of various house buildings and ancillary facilities thereof and the mounting of supporting lines, pipelines and equipment, which comprises factories, theaters, hotels, shops, schools, hospitals and houses, and meets people's needs for production, living, study and public activities.

Cracks often appear in some old houses, and cracks in a concrete structure may be divided into a structural crack and a non-structural crack according to formation causes, and may be divided into a static crack, an active crack and a developing crack according to manifestations.

(1) The structural crack is a crack caused by an external load, and a distribution and a width of the crack are related to the external load. The appearance of such crack indicates that a structural bearing capacity may be insufficient or there are other serious problems.

(2) The non-structural crack is a crack caused by deformation, such as a crack caused by a temperature change, concrete shrinkage and other factors. Such crack has little influence on a bridge bearing capacity.

(3) The static crack is a crack which has stable shape, size and quantity and no longer develops.

(4) The active crack is a crack which has a width always unstable under existing environment and working conditions and is easy to open and close with the stress and deformation of structural members or the changes of environmental temperature and humidity.

(5) The developing crack is a crack which has developing length, width and quantity, but the development thereof will stop after a period of time.

When the cracks are repaired, the cracks are repaired by a grouting method, and within a certain period of time, a cement grouting material, a modified polymer cement grouting material and a non-retractive micro-expansive cement grouting material for repairing the cracks are pressed into cavities of the cracks to fill spaces of the cracks in the concrete structure to form a structural entirety.

In existing crack repair, people often repair the cracks manually, with low repair efficiency. However, some automatic grouting repair machines have a complex structure and a high use cost, and after finishing grouting, the slurry is uneven with a wall surface, so that the aesthetics is poor.

Therefore, it is necessary to provide a single-opening wall crack intelligent grouting machine and a construction method to solve the above technical problems.

SUMMARY

In order to solve the above technical problems, the present disclosure provides a single-opening wall crack intelligent grouting machine and a construction method.

The single-opening wall crack intelligent grouting machine provided by the present disclosure comprises a bottom plate, wherein two lifting mechanisms are symmetrically fixed on an upper surface of the bottom plate, a connecting beam is fixed between the two lifting mechanisms, a middle portion of the connecting beam is slidably connected with a horizontal moving device, a grouting mechanism is fixed on a top portion of the horizontal moving device, a troweling mechanism is fixed on a top portion of the grouting mechanism, and self-locking universal wheels are symmetrically fixed on a lower surface of the bottom plate;

each of the lifting mechanisms comprises a fixed frame, a first slider, a rotating groove, a driving groove, a first servo motor, a first gear and a first rack, the fixed frames are symmetrically fixed on the upper surface of the bottom plate, an inner wall of the fixed frame is slidably connected with the first slider, the two first sliders are fixedly connected with the connecting beam, one end of the first slider close to the connecting beam is provided with the rotating groove, one end of the first slider is provided with the driving groove, the first servo motor is fixed on an inner wall of the driving groove, the first gear is fixed on an output end of the first servo motor extending into an inner wall of the rotating groove and the first gear is rotationally connected with the rotating groove, the first rack is fixed on one side of the inner wall of the fixed frame close to the first gear, and the first gear is engaged with the first rack; and the horizontal moving device comprises a sliding frame, limiting bars, a second servo motor, a second gear and a second rack, the middle portion of the connecting beam is slidably connected with the sliding frame, the limiting bars are symmetrically fixed on an inner wall of the sliding frame and the limiting bars are slidably connected with the connecting beam, the second servo motor is fixed on a lower end of one side of the sliding frame, the second gear is fixed on an output end of the second servo motor, the second rack is fixed on a bottom portion of the connecting beam, and the second gear is engaged with the second rack.

Preferably, the grouting mechanism comprises a first fixed block, a grouting pipe, a sliding pipe, a grouting nozzle, a pressure sensor, a first fixed seat, a first hydraulic cylinder, a second fixed seat, a first fixed plate, a rotating ring, a gear ring, a third servo motor and a third gear, the first fixed block is fixed on a top portion of the sliding frame, the grouting pipe is fixed on a middle portion of the first fixed block, one end of the grouting pipe is slidably connected with the sliding pipe, the grouting nozzle is fixed on one end of the sliding pipe, the pressure sensor is fixed on one end of the grouting nozzle far away from the sliding pipe, the first fixed seat is fixed on one end of the first fixed block, the first hydraulic cylinder is fixed on a middle portion of the first fixed seat, the second fixed seat is fixed on an output end of the first hydraulic cylinder and the second fixed seat is fixedly connected with the sliding pipe, the first fixed plate is fixed on one end of the sliding pipe close to the second fixed seat, one end of the sliding pipe close to the first fixed plate is rotationally connected with the rotating ring through a bearing, the gear ring is fixed on one end of the rotating ring close to the first fixed plate, the third servo motor is fixed on a middle portion of the first fixed plate, the third gear is fixed on an output end of the third servo motor extending through the first fixed plate, and the third gear is engaged with the gear ring.

Preferably, the troweling mechanism comprises a fixed rod, a mounting groove, a first T-shaped groove, a first T-shaped block, a second hydraulic cylinder, a sliding plate, a troweling head and a driving mechanism, the fixed rod is fixed on an outer side of the rotating ring, an upper surface of the fixed rod is provided with the mounting groove, an inner wall of the mounting groove is provided with the first T-shaped groove, an inner wall of the first T-shaped groove is slidably connected with the first T-shaped block, the second hydraulic cylinder is fixed on an inner wall of the mounting groove, an output end of the second hydraulic cylinder is fixedly connected with the first T-shaped block, the sliding plate is fixed on a top portion of the first T-shaped block, one end of the sliding plate far from the fixed rod is slidably connected with the troweling head, and the driving mechanism for driving the troweling head in a reciprocating manner is fixed on an upper surface of the sliding plate.

Preferably the troweling head comprises a second fixed block, a second T-shaped groove, a second T-shaped block, a positioning plate, a troweling plate, sliding rods and springs, the second fixed block is fixed on one end of a lower surface of the sliding plate far away from the fixed rod, one side of the second fixed block is provided with the second T-shaped groove, an inner wall of the second T-shaped groove is slidably connected with the second T-shaped block, the positioning plate is fixed on one end of the second T-shaped block, one side of the positioning plate is provided with the troweling plate, the sliding rods are symmetrically fixed on four corners of the troweling plate, one end of each of the sliding rods is slidably connected with the positioning plate through a sliding hole, each of the springs is arranged around the respective sliding rod, one end of each of the springs is fixedly connected with the positioning plate, and the other end of each of the springs is fixedly connected with the troweling plate.

Preferably, a limiting block is fixed on one end of each of the sliding rods far away from the troweling plate.

Preferably, the driving mechanism comprises a first waist-shaped hole, a first shifting column, a fixed shaft, a rotating rod, a second waist-shaped hole, a third waist-shaped hole, an L-shaped plate, a fourth servo motor, an eccentric wheel and a second shifting column, one end of the upper surface of the sliding plate close to the second T-shaped groove is provided with the first waist-shaped hole 681, the first shifting column is fixed on one end of the second T-shaped block close to the first waist-shaped hole and the first shifting column is slidably connected with the first waist-shaped hole, the fixed shaft is fixed on the upper surface of the sliding plate, a top portion of the fixed shaft is rotationally connected with the rotating rod through a bearing, two ends of the rotating rod are respectively provided with the second waist-shaped hole and the third waist-shaped hole, the first shifting column is slidably connected with an inner wall of the second waist-shaped hole, the L-shaped plate is fixed on the upper surface of the sliding plate, the fourth servo motor is fixed on one end of the L-shaped plate, the eccentric wheel is fixed on an output end of the fourth servo motor extending through the L-shaped plate, the second shifting column is eccentrically fixed on a lower surface of the eccentric wheel, and the second shifting column is slidably connected with an inner wall of the third waist-shaped hole.

Preferably, the inner wall of the fixed frame is symmetrically provided with sliding grooves, sliding blocks matched with the sliding grooves are symmetrically fixed on two ends of the first slider, and the sliding blocks are slidably connected with the respective sliding grooves.

Preferably, a control panel and a singlechip are fixed on one side of one of the fixed frames in sequence.

Preferably, positioning mechanisms are symmetrically fixed on the upper surface of the bottom plate, each of the positioning mechanisms comprises a positioning pipe, a positioning rule and a rotary knob, the positioning pipes are symmetrically fixed on the upper surface of the bottom plate, an inner wall of the positioning pipe is slidably connected with the positioning rule, one end of the positioning rule is provided with a chamfer, one end of the positioning pipe is provided with a threaded hole, an inner wall of the threaded hole is threadedly connected with the threaded rotary knob and the positioning pipe is fixedly connected with the positioning rule through the threaded rotary knob, and a surface of the positioning rule is provided with scales.

Preferably, the first servo motor, the second servo motor, the third servo motor and the fourth servo motor are all worm gear motor.

A construction method applied to the single-opening wall crack intelligent grouting machine according to the present disclosure comprises:

1) cleaning and leveling a construction site;
2) cleaning a wall surface and leveling the wall surface by polishing;
3) placing in place and debugging the single-opening wall crack intelligent grouting machine;
4) operating the single-opening wall crack intelligent grouting machine to grout and trowel a wall crack;
5) detecting the wall crack; and
6) ending construction after flatness of the wall surface is qualified in detection.

Compared with the related art, the single-opening wall crack intelligent grouting machine provided by the present disclosure has the following beneficial effects:

according to the single-opening wall crack intelligent grouting machine provided by the present disclosure:

1. the single grouting mechanism is arranged, and the grouting mechanism is driven to move by the lifting mechanisms and the horizontal moving mechanism to grout a crack, which is low in use cost, flexible in use and suitable for most grouting occasions; and
2. after grouting, the third gear is driven to rotate by the third servo motor, and then the gear ring is driven to rotate, so as to drive the troweling mechanism to rotate, so that the troweling mechanism rotates onto the grouted crack, and the rotating rod is driven to rotate by the fourth servo motor, and then the second T-shaped block is shifted to slide by the first shifting column, so that the troweling head slides in a reciprocating manner, and a slurry on the crack is troweled by the troweling head, thus improving aesthetics.

Figure 1:
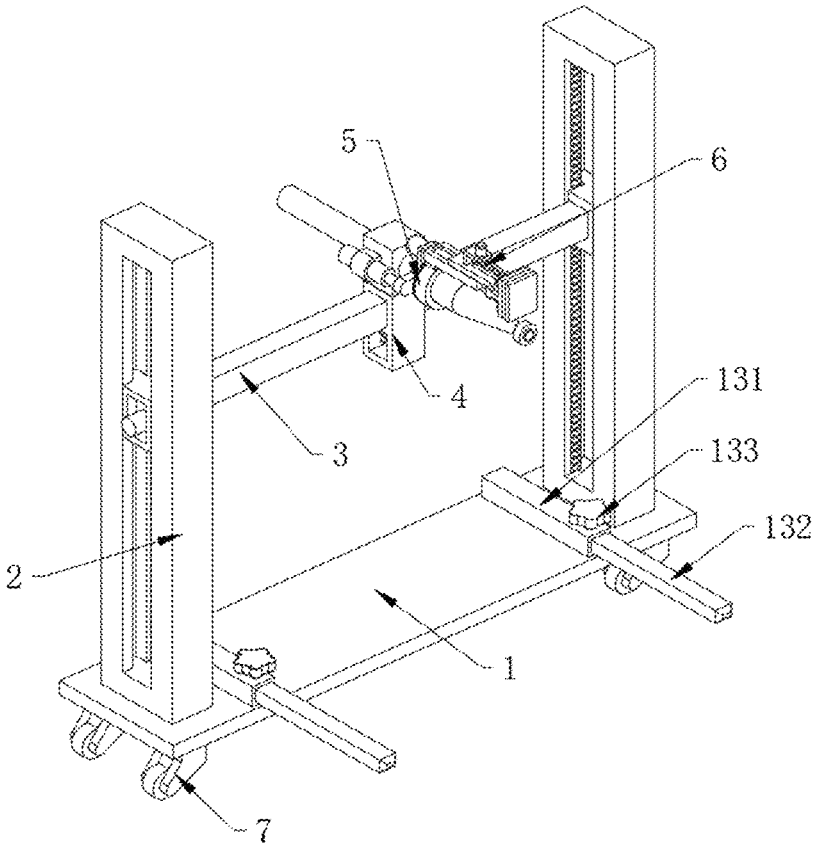
FIG. 1 is a first schematic diagram of an overall structure provided by the present disclosure.

Reference numerals in the drawings: 1 refers to bottom plate; 2 refers to lifting mechanism; 21 refers to fixed frame; 22 refers to first slider; 23 refers to rotating groove; 24 refers to driving groove; 25 refers to first servo motor; 26 refers to first gear; 27 refers to first rack; 3 refers to connecting beam; 4 refers to horizontal moving device; 41 refers to sliding frame; 42 refers to limiting bar; 43 refers to second servo motor; 44 refers to second gear; 45 refers to second rack; 5 refers to grouting mechanism; 51 refers to first fixed block; 52 refers to grouting pipe; 53 refers to sliding pipe; 54 refers to grouting nozzle; 55 refers to pressure sensor; 56 refers to first fixed seat; 57 refers to the first hydraulic cylinder; 58 refers to second fixed seat; 59 refers to first fixed plate; 510 refers to rotating ring; 511 refers to gear ring; 512 refers to third servo motor; 513 refers to third gear; 6 refers to troweling mechanism; 61 refers to fixed rod; 62 refers to mounting groove; 63 refers to first T-shaped groove; 64 refers to first T-shaped block; 65 refers to second hydraulic cylinder; 66 refers to sliding plate; 67 refers to troweling head; 671 refers to second fixed block; 672 refers to second T-shaped groove; 673 refers to second T-shaped block; 674 refers to positioning plate; 675 refers to troweling plate; 676 refers to sliding rod; 677 refers to spring; 68 refers to driving mechanism; 681 refers to first waist-shaped hole; 682 refers to first shifting column; 683 refers to fixed shaft; 684 refers to rotating rod; 685 refers to second waist-shaped hole; 686 refers to third waist-shaped hole; 687 refers to L-shaped plate; 688 refers to fourth servo motor; 689 refers to eccentric wheel; 6810 refers to second shifting column; 7 refers to self-locking universal wheel; 8 refers to sliding groove; 9 refers to sliding block; 10 refers to control panel; 11 refers to limiting block; 12 refers to singlechip; 13 refers to positioning mechanism; 131 refers to positioning pipe; 132 refers to positioning rule; and 133 refers to rotary knob.

DETAILED DESCRIPTION

The present disclosure is further described hereinafter with reference to the drawings and specific embodiments.

Figure 2:
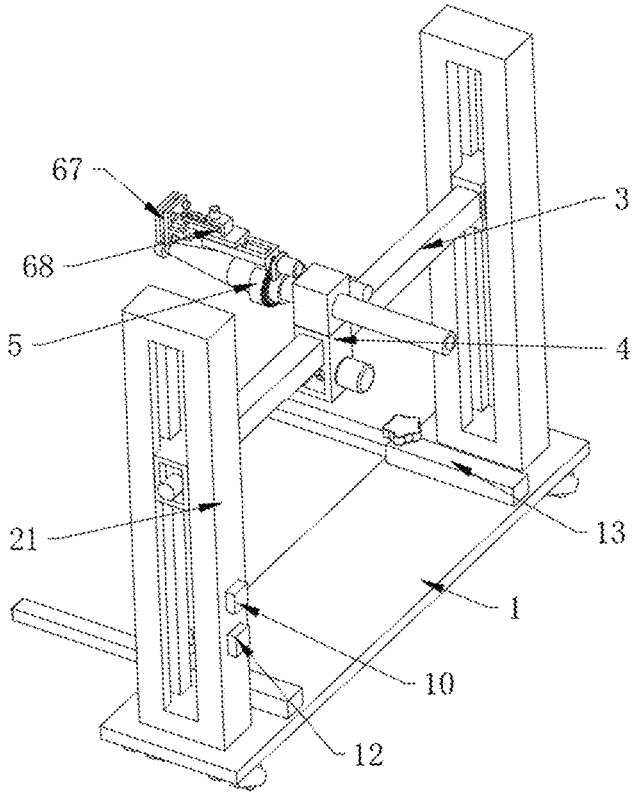
FIG. 2 is a second schematic diagram of the overall structure provided by the present disclosure.
Figure 3:
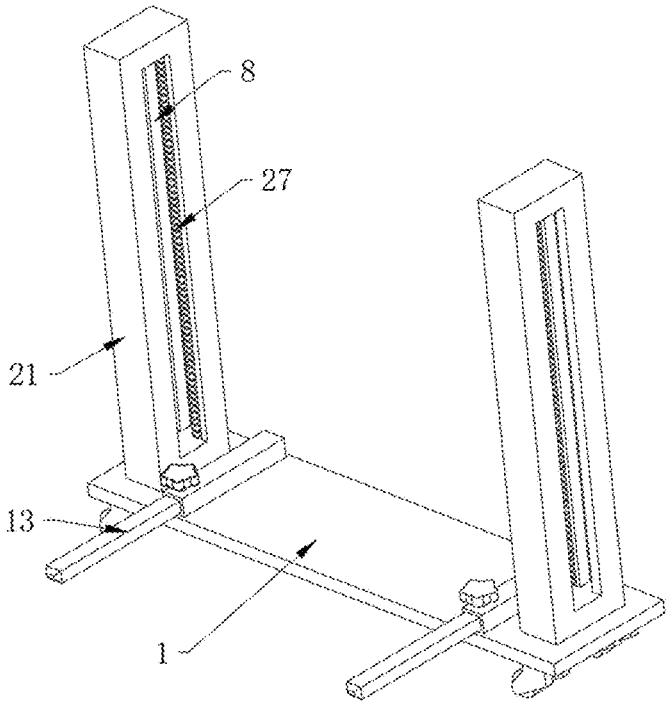
FIG. 3 is a schematic structural diagram of a fixed frame provided by the present disclosure.
Figure 4:
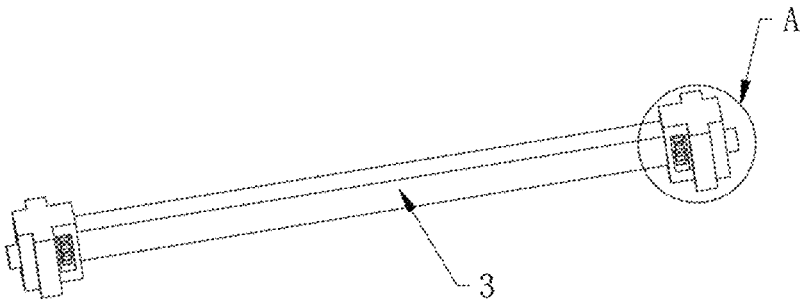
FIG. 4 is a schematic structural diagram of a connecting beam provided by the present disclosure.
Figure 5:
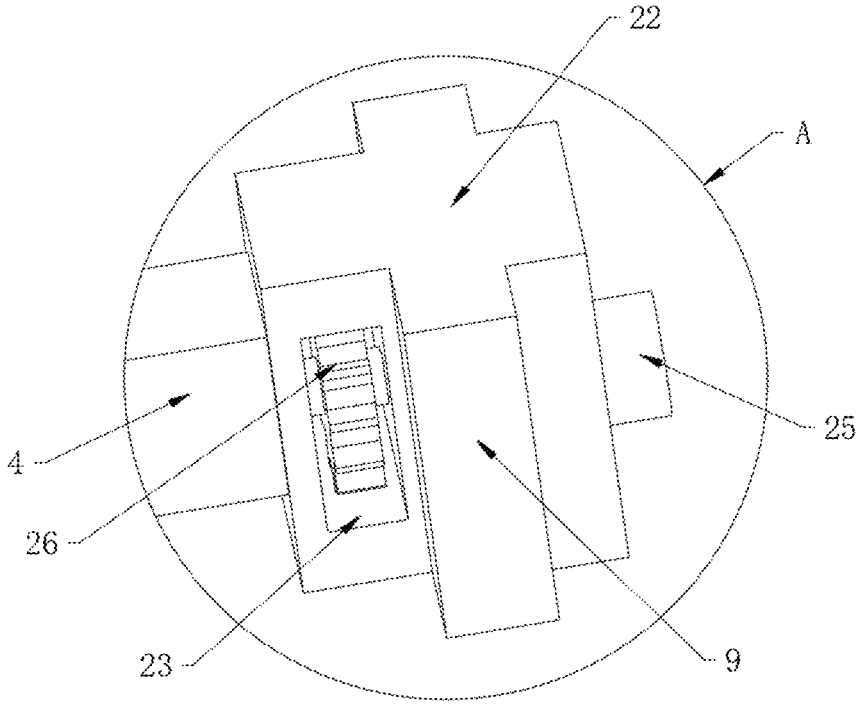
FIG. 5 is an enlarged view of a part A in FIG. 4.

In a specific implementation process, as shown in FIG. 1 and FIG. 2, a single-opening wall crack intelligent grouting machine comprises a bottom plate 1, wherein two lifting mechanisms 2 are symmetrically fixed on an upper surface of the bottom plate 1, a connecting beam 3 is fixed between the two lifting mechanisms 2, a middle portion of the connecting beam 3 is slidably connected with a horizontal moving device 4, a grouting mechanism 5 is fixed on a top portion of the horizontal moving device 4, a troweling mechanism 6 is fixed on a top portion of the grouting mechanism 5, and self-locking universal wheels 7 are symmetrically fixed on a lower surface of the bottom plate 1.

With reference to FIG. 3, FIG. 4, FIG. 5 and FIG. 6, each of the lifting mechanisms 2 comprises a fixed frame 21, a first slider 22, a rotating groove 23, a driving groove 24, a first servo motor 25, a first gear 26 and a first rack 27. The fixed frames 21 are symmetrically fixed on the upper surface of the bottom plate 1, an inner wall of the fixed frame 21 is slidably connected with the first slider 22, the two first sliders 22 are fixedly connected with the connecting beam 3. One end of the first slider 22 close to the connecting beam 3 is provided with the rotating groove 23, one end of the first slider 22 is provided with the driving groove 24. The first servo motor 25 is fixed on an inner wall of the driving groove 24, the first gear 26 is fixed on an output end of the first servo motor 25 extending into an inner wall of the rotating groove 23 and the first gear 26 is rotationally connected with the rotating groove 23. The first rack 27 is fixed on one side of the inner wall of the fixed frame 21 close to the first gear 26, and the first gear 26 is engaged with the first rack 27. The inner wall of the fixed frame 21 is symmetrically provided with sliding grooves 8, sliding blocks 9 matched with the sliding grooves 8 are symmetrically fixed on two ends of the first slider 22, and the sliding block 9 are slidably connected with the respective sliding grooves 8. The first gear 26 is driven to rotate by the rotation of the first servo motor 25, and the first gear 26 is engaged with the first rack 27, so that the first slider 22 is driven to be lifted along the fixed frame 21 by the rotation of the first gear 26, so as to adjust a height of the horizontal moving device 4.

Figure 6:
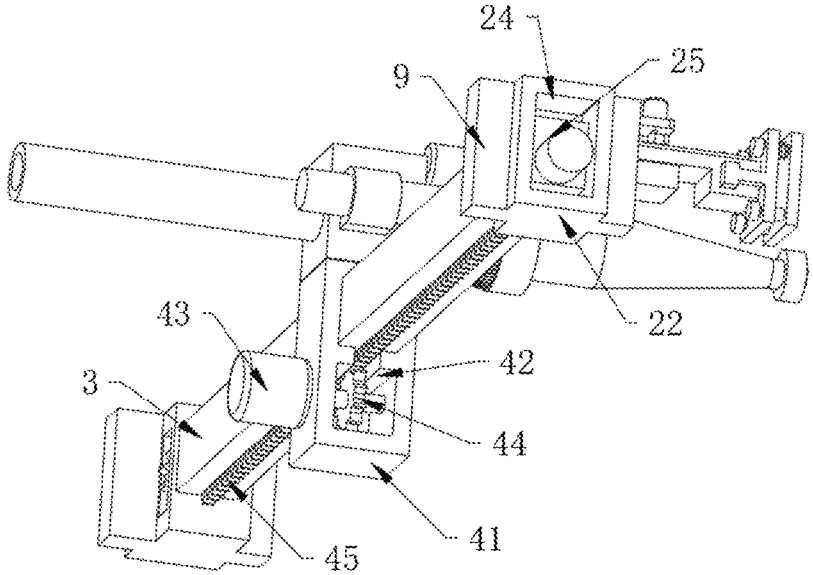
FIG. 6 is a schematic structural diagram of a horizontal moving device provided by the present disclosure.

With reference to FIG. 6, the horizontal moving device 4 comprises a sliding frame 41, limiting bars 42, a second servo motor 43, a second gear 44 and a second rack 45. The middle portion of the connecting beam 3 is slidably connected with the sliding frame 41. The limiting bars 42 are symmetrically fixed on an inner wall of the sliding frame 41 and the limiting bars 42 are slidably connected with the connecting beam 3. The second servo motor 43 is fixed on a lower end of one side of the sliding frame 41, the second gear 44 is fixed on an output end of the second servo motor 43. The second rack 45 is fixed on a bottom portion of the connecting beam 3, and the second gear 44 is engaged with the second rack 45. The second gear 44 is driven to rotate by the rotation of the second servo motor 43, and then the sliding frame 41 can move on the connecting beam 3, so that the grouting mechanism 5 can slide up and down, and left and right.

Figure 7:
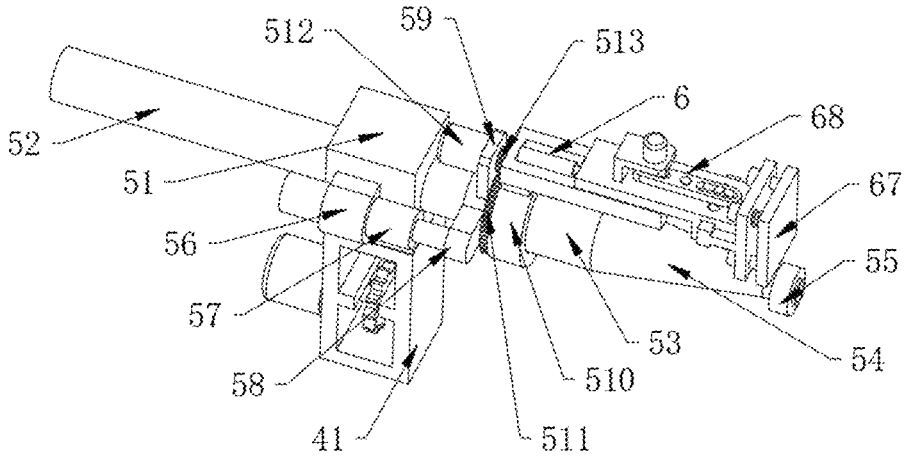
FIG. 7 is a schematic structural diagram of a grouting mechanism provided by the present disclosure.
Figure 12:
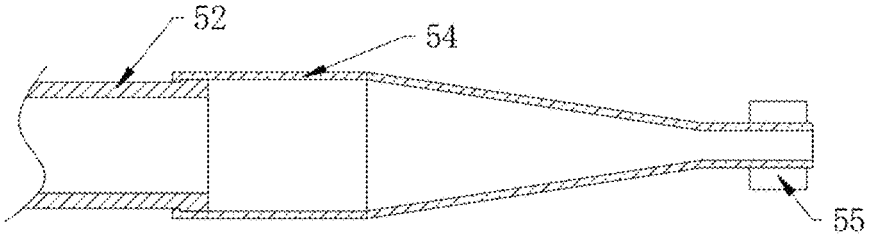
FIG. 12 is a schematic diagram of a sectional structure of a grouting nozzle provided by the present disclosure.

With reference to FIG. 7 and FIG. 12, the grouting mechanism 5 comprises a first fixed block 51, a grouting pipe 52, a sliding pipe 53, a grouting nozzle 54, a pressure sensor 55, a first fixed seat 56, a first hydraulic cylinder 57, a second fixed seat 58, a first fixed plate 59, a rotating ring 510, a gear ring 511, a third servo motor 512 and a third gear 513. The first fixed block 51 is fixed on a top portion of the sliding frame 41, the grouting pipe 52 is fixed on a middle portion of the first fixed block 51, one end of the grouting pipe 52 is slidably connected with the sliding pipe 53, the grouting nozzle 54 is fixed on one end of the sliding pipe 53. The pressure sensor 55 is fixed on one end of the grouting nozzle 54 far away from the sliding pipe 53. The first fixed seat 56 is fixed on one end of the first fixed block 51, the first hydraulic cylinder 57 is fixed on a middle portion of the first fixed seat 56. The second fixed seat 58 is fixed on an output end of the first hydraulic cylinder 57 and the second fixed seat 58 is fixedly connected with the sliding pipe 53. The first fixed plate 59 is fixed on one end of the sliding pipe 53 close to the second fixed seat 58, one end of the sliding pipe 53 close to the first fixed plate 59 is rotationally connected with the rotating ring 510 through a bearing. The gear ring 511 is fixed on one end of the rotating ring 510 close to the first fixed plate 59, the third servo motor 512 is fixed on a middle portion of the first fixed plate 59, the third gear 513 is fixed on an output end of the third servo motor 512 extending through the first fixed plate 59, and the third gear 513 is engaged with the gear ring 511. The first hydraulic cylinder 57 pushes the sliding pipe 53 to extend and retract, so as to drive the pressure sensor 55 on the grouting nozzle 54 to be in contact with a wall surface. Whether the grouting nozzle 54 is in contact with the wall surface is detected by the pressure sensor 55. The pressure sensor 55 is driven to move on the wall surface by the lifting mechanism 2 and the horizontal moving mechanism. When the pressure sensor 55 detects that a pressure is greater than zero, the grouting is not carried out, and when the pressure sensor detects that the pressure is equal to zero, it is indicated that the pressure sensor 55 is located in a position of the crack. In this case, the first hydraulic cylinder 57 continuously drives the grouting nozzle 54 to move into the crack until the pressure is detected again, and a displacement distance is recorded. Then the grouting is carried out via the grouting pipe 52, and the grouting pipe 52 is connected with a high-pressure pump for grouting, so that the slurry is injected into the crack through the grouting nozzle 54, and the first hydraulic cylinder 57 retracts during grouting until the grouting nozzle 54 retracts by the recorded distance, which indicates that the grouting is finished. Then, the grouting mechanism 5 is driven to move upwardly for a certain distance by the lifting mechanism 2, and the above operation is repeated again to finish the grouting of the crack.

Figure 8:
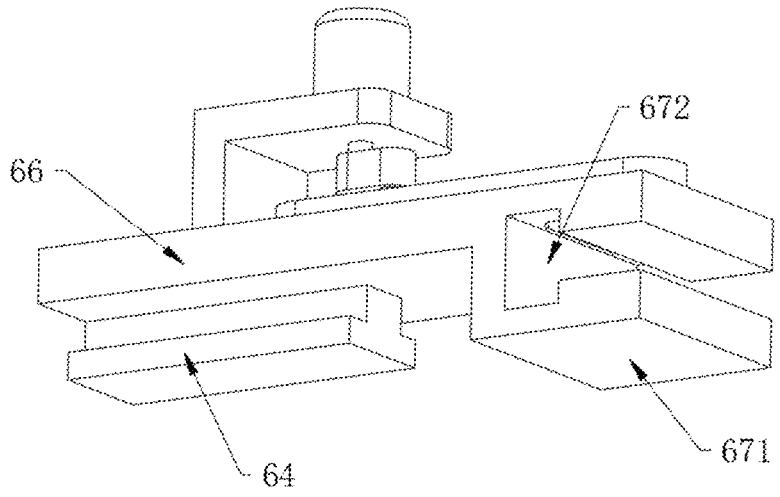
FIG. 8 is a schematic structural diagram of a T-shaped block provided by the present disclosure.
Figure 9:
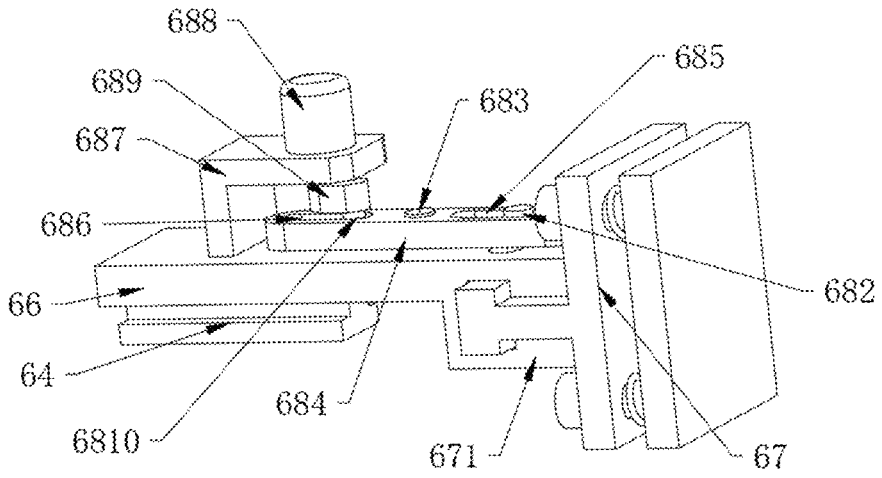
FIG. 9 is a schematic structural diagram of a driving mechanism provided by the present disclosure.
Figure 11:
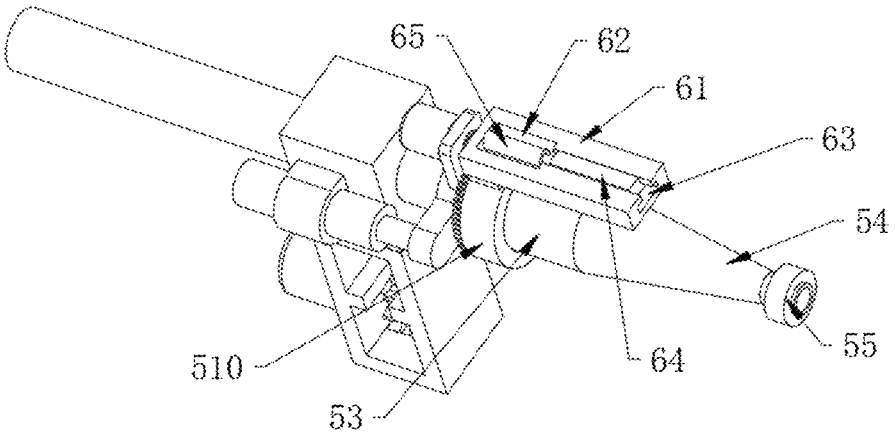
FIG. 11 is a schematic structural diagram of a second hydraulic cylinder provided by the present disclosure.

With reference to FIG. 8, FIG. 9 and FIG. 11, the troweling mechanism 6 comprises a fixed rod 61, a mounting groove 62, a first T-shaped groove 63, a first T-shaped block 64, a second hydraulic cylinder 65, a sliding plate 66, a troweling head 67 and a driving mechanism 68. The fixed rod 61 is fixed on an outer side of the rotating ring 510, an upper surface of the fixed rod 61 is provided with the mounting groove 62, an inner wall of the mounting groove 62 is provided with the first T-shaped groove 63, an inner wall of the first T-shaped groove 63 is slidably connected with the first T-shaped block 64. The second hydraulic cylinder 65 is fixed on an inner wall of the mounting groove 62, an output end of the second hydraulic cylinder 65 is fixedly connected with the first T-shaped block 64. The sliding plate 66 is fixed on a top portion of the first T-shaped block 64, one end of the sliding plate 66 far from the fixed rod 61 is slidably connected with the troweling head 67, and the driving mechanism 68 for driving the troweling head 67 in a reciprocating manner is fixed on an upper surface of the sliding plate 66.

Figure 10:
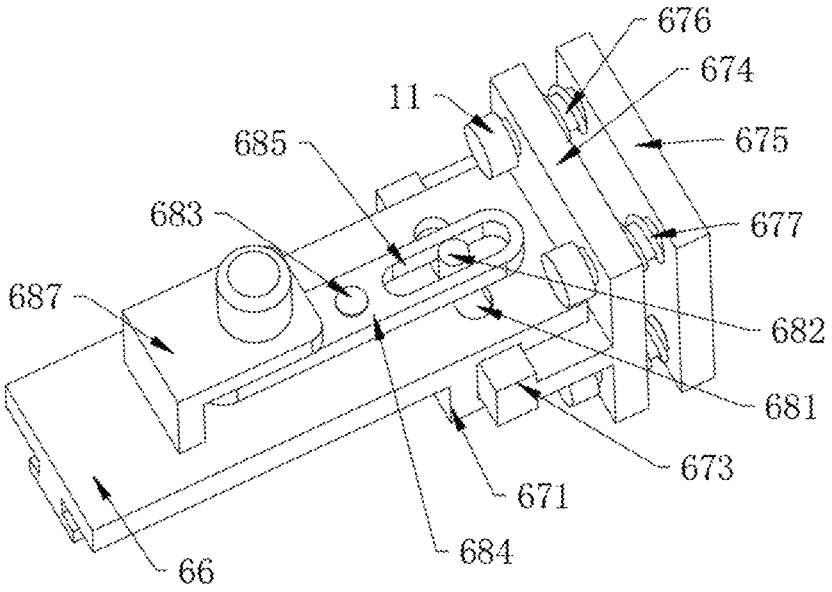
FIG. 10 is a schematic structural diagram of a troweling head provided by the present disclosure.

With reference to FIG. 8, FIG. 9 and FIG. 10, the troweling head 67 comprises a second fixed block 671, a second T-shaped groove 672, a second T-shaped block 673, a positioning plate 674, a troweling plate 675, sliding rods 676 and springs 677. The second fixed block 671 is fixed on one end of a lower surface of the sliding plate 66 far away from the fixed rod 61, one side of the second fixed block 671 is provided with the second T-shaped groove 672, an inner wall of the second T-shaped groove 672 is slidably connected with the second T-shaped block 673. The positioning plate 674 is fixed on one end of the second T-shaped block 673, one side of the positioning plate 674 is provided with the troweling plate 675, the sliding rods 676 are symmetrically fixed on four corners of the troweling plate 675. One end of the sliding rods 676 is slidably connected with the positioning plate 674 through a sliding hole, each of the springs 677 is arranged around the respective sliding rod 676. One end of each of the springs 677 is fixedly connected with the positioning plate 674, and the other end of each of the springs 677 is fixedly connected with the troweling plate 675. A limiting block 11 is fixed on one end of each of the sliding rods 676 far away from the troweling plate 675. The springs 677 support a part between the troweling plate 675 and the positioning plate 674, so that the troweling plate 675 can extend and retract by a certain amount of deformation, which is convenient for troweling the slurry.

With reference to FIG. 9 and FIG. 10, the driving mechanism 68 comprises a first waist-shaped hole 681, a first shifting column 682, a fixed shaft 683, a rotating rod 684, a second waist-shaped hole 685, a third waist-shaped hole 686, an L-shaped plate 687, a fourth servo motor 688, an eccentric wheel 689 and a second shifting column 6810. One end of the upper surface of the sliding plate 66 close to the second T-shaped groove 672 is provided with the first waist-shaped hole 681. The first shifting column 682 is fixed on one end of the second T-shaped block 673 close to the first waist-shaped hole 681 and the first shifting column 682 is slidably connected with the first waist-shaped hole 681. The fixed shaft 683 is fixed on the upper surface of the sliding plate 66, a top portion of the fixed shaft 683 is rotationally connected with the rotating rod 684 through a bearing, two ends of the rotating rod 684 are respectively provided with the second waist-shaped hole 685 and the third waist-shaped hole 686. The first shifting column 682 is slidably connected with an inner wall of the second waist-shaped hole 685. The L-shaped plate 687 is fixed on the upper surface of the sliding plate 66, the fourth servo motor 688 is fixed on one end of the L-shaped plate 687, the eccentric wheel 689 is fixed on an output end of the fourth servo motor 688 extending through the L-shaped plate 687. The second shifting column 6810 is eccentrically fixed on a lower surface of the eccentric wheel 689, and the second shifting column 6810 is slidably connected with an inner wall of the third waist-shaped hole 686. During grouting, the last grouting position is recorded, then the third gear 513 is driven to rotate by the third servo motor 512, and then the gear ring 511 is driven to rotate, so that the gear ring 511 drives the troweling mechanism 6 to rotate through the rotating ring 510, and the troweling plate 675 on the troweling mechanism 6 moves to the last grouting position. The sliding plate 66 is pushed to slide by the second hydraulic cylinder 65, so as to drive the troweling plate 675 to be in contact with the wall surface, and a certain pressure is applied on the wall surface by the springs 677. At the moment, the eccentric wheel 689 is driven to rotate by the rotation of the fourth servo motor 688, then the third waist-shaped hole 686 is shifted to move by the second shifting column 6810, and then the rotating rod 684 is driven to rotate around the fixed shaft 683, so that the rotating rod 684 pushes the first shifting column 682 to move through the second waist-shaped hole 685. The first shifting column 682 slides in the first waist-shaped hole 681 in a limited manner, then the rotating rod 684 drives the first shifting column 682 to slide in the first waist-shaped hole 681, and then the second T-shaped block 673 slides left and right in a reciprocating manner, so that the troweling head 67 slides in a reciprocating manner, and then the troweling plate 675 slides left and right on a surface of the grouted crack. The slurry is troweled by the troweling plate 675, and the slurry is troweled left and right to exert a certain vibration effect on the slurry, so that the slurry is more compact and the surface is flatter.

With reference to FIG. 2, a control panel 10 and a singlechip 12 are fixed on one side of one of the fixed frames 21 in sequence to facilitate controlling electrical equipment. Circuits and controls involved in the present disclosure all belong to the prior art, and will not be repeated herein.

With reference to FIG. 1, positioning mechanisms 13 are symmetrically fixed on the upper surface of the bottom plate 1, each of the positioning mechanisms 13 comprises a positioning pipe 131, a positioning rule 132 and a rotary knob 133. The positioning pipes 131 are symmetrically fixed on the upper surface of the bottom plate 1, an inner wall of the positioning pipe 131 is slidably connected with the positioning rule 132, one end of the positioning rule 132 is provided with a chamfer, one end of the positioning pipe 131 is provided with a threaded hole, an inner wall of the threaded hole is threadedly connected with the threaded rotary knob 133 and the positioning pipe 131 is fixedly connected with the positioning rule 132 through the threaded rotary knob 133, and a surface of the positioning rule 132 is provided with scales. The device is moved to a wall side through the self-locking universal wheels 7, then the positioning rules 132 are slid to the same scale by loosening the respective rotary knobs 133, and then the bottom plate 1 is moved until tips of two positioning rules 132 are both in contact with the wall surface, so that the device is kept parallel to the wall surface.

The first servo motor 25, the second servo motor 43, the third servo motor 512 and the fourth servo motor 688 are all worm gear motor.

Figure 13:
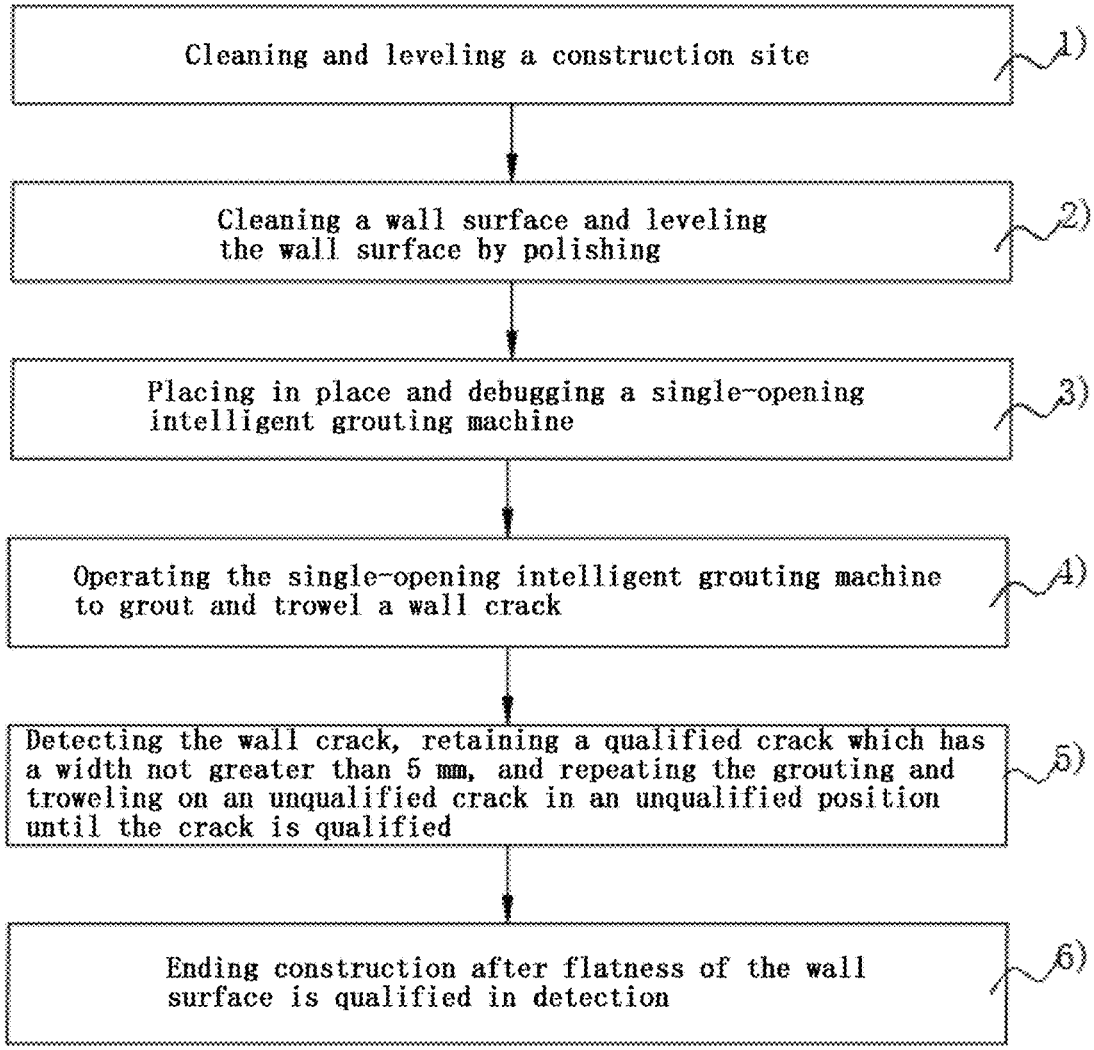
FIG. 13 is a flow chart of construction provided by the present disclosure.

With reference to FIG. 13, a construction method is applied to the grouting machine according to the present disclosure, wherein the construction method comprises the following steps of:

1) cleaning and leveling a construction site;
2) cleaning a wall surface and leveling the wall surface by polishing;
3) placing in place and debugging the single-opening wall crack intelligent grouting machine;
4) operating the single-opening wall crack intelligent grouting machine to grout and trowel a wall crack;
5) detecting the wall crack, retaining a qualified crack which has a width not greater than 5 mm, and repeating the grouting and troweling on an unqualified crack in an unqualified position until the crack is qualified; and
6) ending construction after flatness of the wall surface is qualified in detection.

A working principle of the single-opening wall crack intelligent grouting machine is as follows.

When in use, the device is moved to a wall side through the self-locking universal wheels 7, then the positioning rules 132 are slid to the same scale by loosening the respective rotary knobs 133, and then the bottom plate 1 is moved until tips of two positioning rules 132 are both in contact with the wall surface, so that the device is kept parallel to the wall surface. At the moment, the first gear 26 is driven to rotate by the rotation of the first servo motor 25, and the first gear 26 is engaged with the first rack 27, so that the first slider 22 is driven to be lifted along the fixed frame 21 by the rotation of the first gear 26, so as to adjust the height of the horizontal moving device 4. Then, the second gear 44 is driven to move by the rotation of the second servo motor 43, and then the sliding frame 41 may move on the connecting beam 3, so that the grouting mechanism 5 may slide up and down, and left and right. The first hydraulic cylinder 57 pushes the sliding pipe 53 to extend and retract, so as to drive the pressure sensor 55 on the grouting nozzle 54 to be in contact with the wall surface, and whether the grouting nozzle 54 is in contact with the wall surface is detected by the pressure sensor 55. The pressure sensor 55 is driven to move on the wall surface by the lifting mechanism 2 and the horizontal moving mechanism, when the pressure sensor 55 detects that a pressure is greater than zero, the grouting is not carried out, and when the pressure sensor detects that the pressure is equal to zero, it is indicated that the pressure sensor 55 is located in a position of the crack, then the first hydraulic cylinder 57 continuously drives the grouting nozzle 54 to move into the crack until the pressure is detected again, and a displacement distance is recorded. Alternatively, when a displacement value of the grouting nozzle 54 is equal to a preset displacement value, the grouting is carried out by the grouting pipe 52, and the grouting pipe 52 is connected with a high-pressure pump for grouting, so that the slurry is injected into the crack through the grouting nozzle 54, and the first hydraulic cylinder 57 retracts during grouting until the grouting nozzle 54 retracts by the recorded distance, which indicates that the grouting is finished. Then, the grouting mechanism 5 is driven to move upwardly for a certain distance by the lifting mechanism 2, and the above operation is repeated again to finish the grouting of the crack. Moreover, during grouting, the last grouting position is recorded, then the third gear 513 is driven to rotate by the third servo motor 512, and then the gear ring 511 is driven to rotate, so that the gear ring 511 drives the troweling mechanism 6 to rotate through the rotating ring 510, and the troweling plate 675 on the troweling mechanism 6 moves to the last grouting position. The sliding plate 66 is pushed to slide by the second hydraulic cylinder 65, so as to drive the troweling plate 675 to be in contact with the wall surface, and a certain pressure is applied on the wall surface by the spring 677. At the moment, the eccentric wheel 689 is driven to rotate by the rotation of the fourth servo motor 688, then the third waist-shaped hole 686 is shifted to move by the second shifting column 6810, and then the rotating rod 684 is driven to rotate around the fixed shaft 683, so that the rotating rod 684 pushes the first shifting column 682 to move through the second waist-shaped hole 685. The first shifting column 682 slides in the first waist-shaped hole 681 in a limited manner, then the rotating rod 684 drives the first shifting column 682 to slide in the first waist-shaped hole 681, and then the second T-shaped block 673 slides left and right in a reciprocating manner, so that the troweling head 67 slides in a reciprocating manner, and then the troweling plate 675 slides left and right on a surface of the grouted crack. The slurry is troweled by the troweling plate 675, and the slurry is troweled left and right to exert a certain vibration effect on the slurry, so that the slurry is more compact and the surface is flatter.

The above are only the embodiments of the present disclosure, and are not intended to limit the patent scope of the present disclosure. Any equivalent structures or equivalent process transformations made by utilizing the contents of the specification and the drawings of the present disclosure, or directly or indirectly applied in other related technical fields are equally included in the scope of protection of the patent of the present disclosure.

What is claimed is:

1. A single-opening wall crack intelligent grouting machine, comprising a bottom plate, wherein two lifting mechanisms are symmetrically fixed on an upper surface of the bottom plate, a connecting beam is fixed between the two lifting mechanisms, a middle portion of the connecting beam is slidably connected with a horizontal moving device, a grouting mechanism is fixed on a top portion of the horizontal moving device, a troweling mechanism is fixed on a top portion of the grouting mechanism, and self-locking universal wheels are symmetrically fixed on a lower surface of the bottom plate;

each of the lifting mechanisms comprises a fixed frame, a first slider, a rotating groove, a driving groove, a first servo motor, a first gear and a first rack, the fixed frames are symmetrically fixed on the upper surface of the bottom plate, an inner wall of the fixed frame is slidably connected with the first slider, the two first sliders are fixedly connected with the connecting beam, one end of the first slider close to the connecting beam is provided with the rotating groove, one end of the first slider is provided with the driving groove, the first servo motor is fixed on an inner wall of the driving groove, the first gear is fixed on an output end of the first servo motor extending into an inner wall of the rotating groove and the first gear is rotationally connected with the rotating groove, the first rack is fixed on one side of the inner wall of the fixed frame close to the first gear, and the first gear is engaged with the first rack; and the horizontal moving device comprises a sliding frame, limiting bars, a second servo motor, a second gear and a second rack, the middle portion of the connecting beam is slidably connected with the sliding frame, the limiting bars are symmetrically fixed on an inner wall of the sliding frame and the limiting bars are slidably connected with the connecting beam, the second servo motor is fixed on a lower end of one side of the sliding frame, the second gear is fixed on an output end of the second servo motor, the second rack is fixed on a bottom portion of the connecting beam, and the second gear is engaged with the second rack.

2. The single-opening wall crack intelligent grouting machine according to claim 1, wherein the grouting mechanism comprises a first fixed block, a grouting pipe, a sliding pipe, a grouting nozzle, a pressure sensor, a first fixed seat, a first hydraulic cylinder, a second fixed seat, a first fixed plate, a rotating ring, a gear ring, a third servo motor and a third gear, the first fixed block is fixed on a top portion of the sliding frame, the grouting pipe is fixed on a middle portion of the first fixed block, one end of the grouting pipe is slidably connected with the sliding pipe, the grouting nozzle is fixed on one end of the sliding pipe, the pressure sensor is fixed on one end of the grouting nozzle far away from the sliding pipe, the first fixed seat is fixed on one end of the first fixed block, the first hydraulic cylinder is fixed on a middle portion of the first fixed seat, the second fixed seat is fixed on an output end of the first hydraulic cylinder and the second fixed seat is fixedly connected with the sliding pipe, the first fixed plate is fixed on one end of the sliding pipe close to the second fixed seat, one end of the sliding pipe close to the first fixed plate is rotationally connected with the rotating ring through a bearing, the gear ring is fixed on one end of the rotating ring close to the first fixed plate, the third servo motor is fixed on a middle portion of the first fixed plate, the third gear is fixed on an output end of the third servo motor extending through the first fixed plate, and the third gear is engaged with the gear ring.

3. The single-opening wall crack intelligent grouting machine according to claim 2, wherein the troweling mechanism comprises a fixed rod, a mounting groove, a first T-shaped groove, a first T-shaped block, a second hydraulic cylinder, a sliding plate, a troweling head and a driving mechanism, the fixed rod is fixed on an outer side of the rotating ring, an upper surface of the fixed rod is provided with the mounting groove, an inner wall of the mounting groove is provided with the first T-shaped groove, an inner wall of the first T-shaped groove is slidably connected with the first T-shaped block, the second hydraulic cylinder is fixed on an inner wall of the mounting groove, an output end of the second hydraulic cylinder is fixedly connected with the first T-shaped block, the sliding plate is fixed on a top portion of the first T-shaped block, one end of the sliding plate far from the fixed rod is slidably connected with the troweling head, and the driving mechanism for driving the troweling head in a reciprocating manner is fixed on an upper surface of the sliding plate.

4. The single-opening wall crack intelligent grouting machine according to claim 3, wherein the troweling head comprises a second fixed block, a second T-shaped groove, a second T-shaped block, a positioning plate, a troweling plate, sliding rods and springs, the second fixed block is fixed on one end of a lower surface of the sliding plate far away from the fixed rod, one side of the second fixed block is provided with the second T-shaped groove, an inner wall of the second T-shaped groove is slidably connected with the second T-shaped block, the positioning plate is fixed on one end of the second T-shaped block, one side of the positioning plate is provided with the troweling plate, the sliding rods are symmetrically fixed on four corners of the troweling plate, one end of each of the sliding rods is slidably connected with the positioning plate through a sliding hole, each of the springs is arranged around the respective sliding rod, one end of each of the springs is fixedly connected with the positioning plate, and the other end of each of the springs is fixedly connected with the troweling plate.

5. The single-opening wall crack intelligent grouting machine according to claim 4, wherein a limiting block is fixed on one end of each of the sliding rods far away from the troweling plate.

6. The single-opening wall crack intelligent grouting machine according to claim 4, wherein the driving mechanism comprises a first waist-shaped hole, a first shifting column, a fixed shaft, a rotating rod, a second waist-shaped hole, a third waist-shaped hole, an L-shaped plate, a fourth servo motor, an eccentric wheel and a second shifting column, one end of the upper surface of the sliding plate close to the second T-shaped groove is provided with the first waist-shaped hole, the first shifting column is fixed on one end of the second T-shaped block close to the first waist-shaped hole and the first shifting column is slidably connected with the first waist-shaped hole, the fixed shaft is fixed on the upper surface of the sliding plate, a top portion of the fixed shaft is rotationally connected with the rotating rod through a bearing, two ends of the rotating rod are respectively provided with the second waist-shaped hole and the third waist-shaped hole, the first shifting column is slidably connected with an inner wall of the second waist-shaped hole, the L-shaped plate is fixed on the upper surface of the sliding plate, the fourth servo motor is fixed on one end of the L-shaped plate, the eccentric wheel is fixed on an output end of the fourth servo motor extending through the L-shaped plate, the second shifting column is eccentrically fixed on a lower surface of the eccentric wheel, and the second shifting column is slidably connected with an inner wall of the third waist-shaped hole.

7. The single-opening wall crack intelligent grouting machine according to claim 1, wherein the inner wall of the fixed frame is symmetrically provided with sliding grooves, sliding blocks matched with the sliding grooves are symmetrically fixed on two ends of the first slider, and the sliding blocks are slidably connected with the respective sliding grooves.

8. The single-opening wall crack intelligent grouting machine according to claim 1, wherein a control panel and a singlechip are fixed on one side of one of the fixed frames in sequence.

9. The single-opening wall crack intelligent grouting machine according to claim 1, wherein positioning mechanisms are symmetrically fixed on the upper surface of the bottom plate, each of the positioning mechanisms comprises a positioning pipe, a positioning rule and a rotary knob, the positioning pipes are symmetrically fixed on the upper surface of the bottom plate, an inner wall of the positioning pipe is slidably connected with the positioning rule, one end of the positioning rule is provided with a chamfer, one end of the positioning pipe is provided with a threaded hole, an inner wall of the threaded hole is threadedly connected with the threaded rotary knob and the positioning pipe is fixedly connected with the positioning rule through the threaded rotary knob, and a surface of the positioning rule is provided with scales.

10. A construction method, applied to the single-opening wall crack intelligent grouting machine according to claim 1, wherein the construction method comprises:

1) cleaning and leveling a construction site;
2) Cleaning a wall surface and leveling the wall surface by polishing;
3) Placing in place and debugging the single-opening wall crack intelligent grouting machine;
4) Operating the single-opening wall crack intelligent grouting machine to grout and trowel a wall crack;
5) detecting the wall crack; and
6) Ending construction after flatness of the wall surface is qualified in detection.

* * * * *